US008979143B1

(12) United States Patent
Lin

(10) Patent No.: US 8,979,143 B1
(45) Date of Patent: Mar. 17, 2015

(54) FIRE BOLT ASSEMBLY FOR A DOOR

(71) Applicant: I-TEK Metal Mfg. Co., Ltd., Tainan (TW)

(72) Inventor: Hsi-Ting Lin, Tainan (TW)

(73) Assignee: I-TEK Metal Mfg. Co., Ltd., Tainan (TW)

( * ) Notice: Subject to any disclaimer, the term of this patent is extended or adjusted under 35 U.S.C. 154(b) by 22 days.

(21) Appl. No.: 14/036,004

(22) Filed: Sep. 25, 2013

(51) Int. Cl.
*E05C 1/08* (2006.01)
*E05B 17/20* (2006.01)
*E05B 65/10* (2006.01)

(52) U.S. Cl.
CPC ..... *E05B 17/2007* (2013.01); *E05B 65/104* (2013.01); *Y10S 292/66* (2013.01)
USPC ..... 292/163; 292/92; 292/153; 292/DIG. 66

(58) Field of Classification Search
CPC ..... E05B 65/104
USPC ..... 292/92, 153, 163, DIG. 66
See application file for complete search history.

(56) References Cited

U.S. PATENT DOCUMENTS

| | | | | | |
|---|---|---|---|---|---|
| 80,295 | A | * | 7/1868 | Lotridge | 292/153 |
| 756,453 | A | * | 4/1904 | Arens et al. | 292/163 |
| 919,750 | A | * | 4/1909 | Neumeister | 292/60 |
| 1,287,080 | A | * | 12/1918 | Newman | 292/138 |
| 1,768,326 | A | * | 6/1930 | Miller | 292/153 |
| 2,471,159 | A | * | 5/1949 | MacDonald | 292/181 |
| 2,492,322 | A | * | 12/1949 | Russell | 292/167 |
| 2,516,630 | A | * | 7/1950 | Hufnagel | 292/163 |
| 3,018,535 | A | * | 1/1962 | Griffin | 24/625 |
| 3,325,941 | A | * | 6/1967 | Prucha | 49/7 |
| 3,705,739 | A | * | 12/1972 | Adler | 292/92 |
| 4,012,066 | A | * | 3/1977 | Salvatore | 292/341.13 |
| 4,183,565 | A | * | 1/1980 | Allemann | 292/163 |
| 4,363,420 | A | * | 12/1982 | Andrews | 220/787 |
| 4,504,009 | A | * | 3/1985 | Boik et al. | 229/5.5 |
| 4,539,929 | A | * | 9/1985 | Sestak et al. | 116/221 |
| 4,714,285 | A | * | 12/1987 | Langham | 292/163 |
| 4,884,832 | A | * | 12/1989 | Bungard | 292/173 |
| 5,042,854 | A | * | 8/1991 | Huang | 292/175 |
| 5,121,950 | A | * | 6/1992 | Davidian | 292/164 |
| 5,380,053 | A | * | 1/1995 | Saino | 292/144 |
| 5,427,420 | A | * | 6/1995 | Moore | 292/169 |
| 5,690,371 | A | * | 11/1997 | Turnbull | 292/163 |
| 5,782,509 | A | * | 7/1998 | Uyeda | 292/92 |

(Continued)

FOREIGN PATENT DOCUMENTS

| | | | | |
|---|---|---|---|---|
| CA | 2538437 | A1 * | 9/2006 | |
| DE | 3315351 | A1 * | 10/1984 | E05C 15/02 |

*Primary Examiner* — Carlos Lugo
(74) *Attorney, Agent, or Firm* — Alan D. Kamrath; Kamrath IP Lawfirm, P.A.

(57) ABSTRACT

A fire bolt assembly (10) includes a receiving tube (117) mounted in a door (106). A mounting member (32) is mounted to the receiving tube (117). A positioning bolt (151) is received in the receiving tube (117). A stop member (58) is securely mounted in the mounting member (32) to hold the positioning bolt (151) in the receiving tube (117). The front end (153) of the positioning bolt (151) is moved out of the receiving tube (117) by a spring (100) to engage with a coupling hole (116) in another door (112) or a door frame when the stop member (58) melts due to the heat of a fire, locking the door (106) in place during the fire. A stick (175) in the receiving tube (117) is moved to a blocking position preventing the front end (153) of the positioning bolt (151) from disengaging from the coupling hole (116).

3 Claims, 8 Drawing Sheets

(56) References Cited

U.S. PATENT DOCUMENTS

| | | | | |
|---|---|---|---|---|
| 6,588,809 | B1 * | 7/2003 | Derman | 292/129 |
| 6,708,979 | B2 * | 3/2004 | Stratman et al. | 277/316 |
| 7,347,655 | B2 * | 3/2008 | Nagasawa et al. | 411/508 |
| 7,481,468 | B2 * | 1/2009 | Merideth et al. | 292/137 |
| 7,488,012 | B2 * | 2/2009 | Eller et al. | 292/164 |
| 2005/0284030 | A1 * | 12/2005 | Autovino et al. | 52/1 |
| 2011/0204658 | A1 * | 8/2011 | Lin | 292/92 |

* cited by examiner

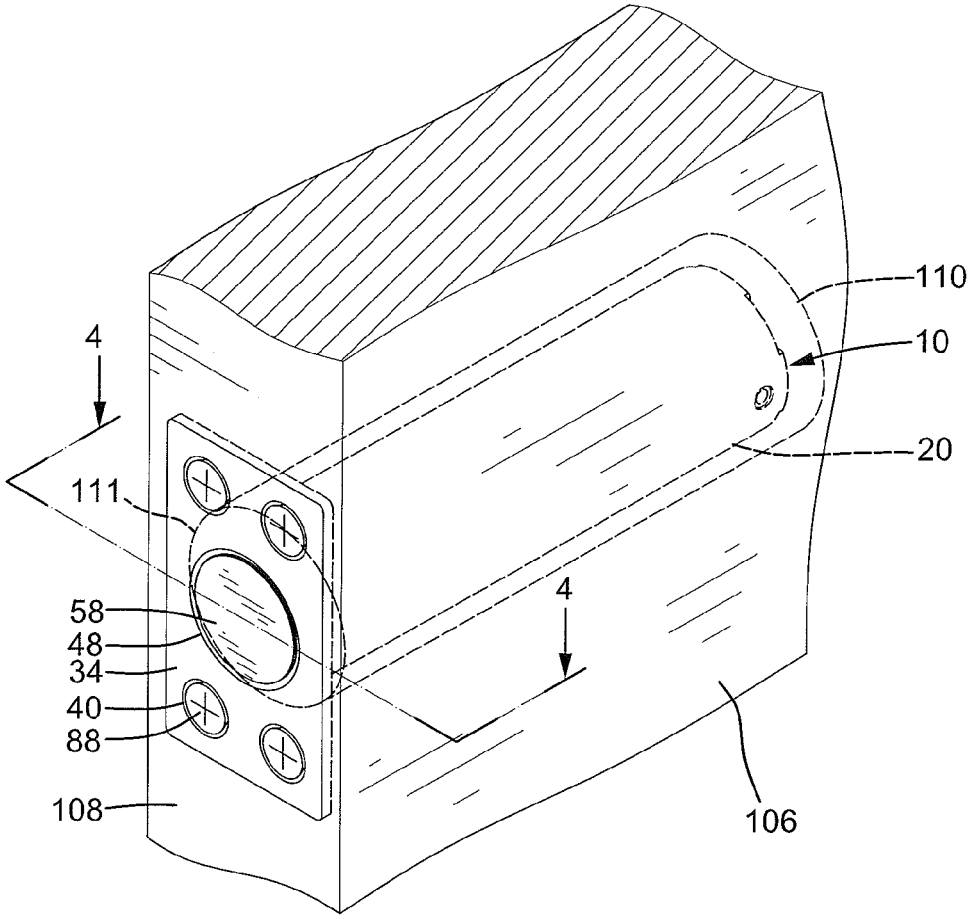
FIG.1
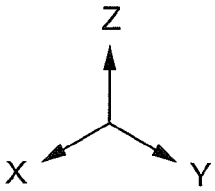

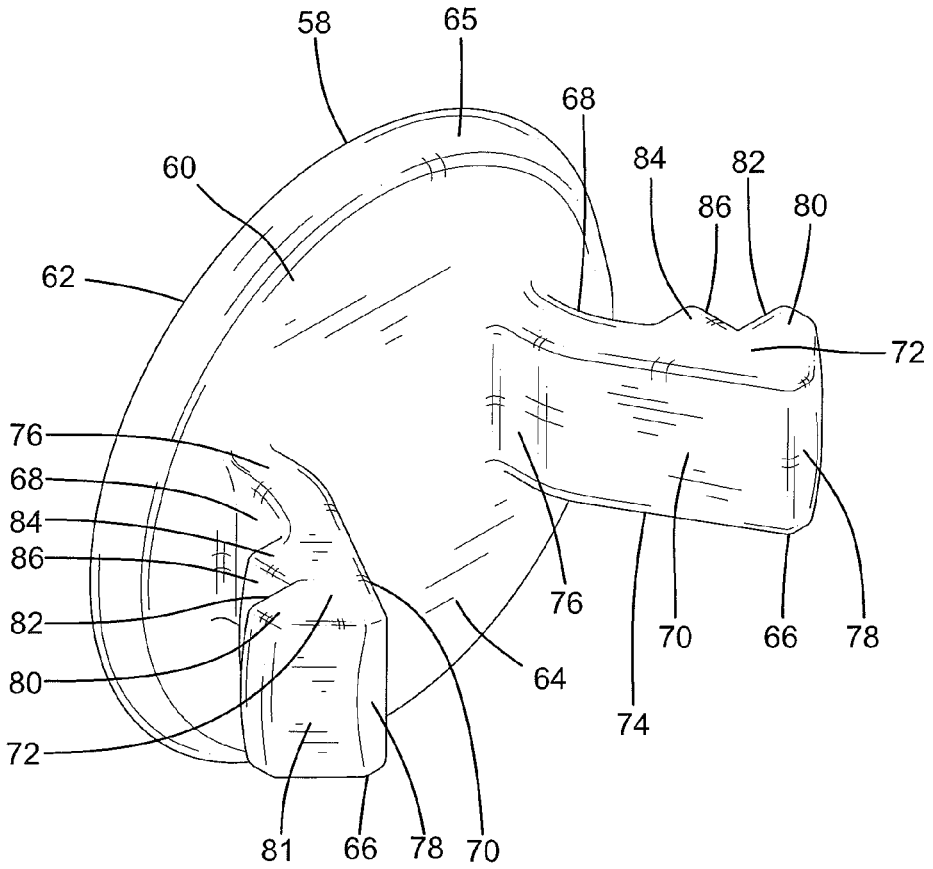
FIG.3
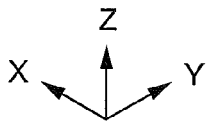

FIRE BOLT ASSEMBLY FOR A DOOR

BACKGROUND OF THE INVENTION

The present invention relates to a fire bolt assembly and, more particularly, to a fire bolt assembly preventing opening of a door when exposed to a fire.

It is known to mount a fire bolt assembly in a door for automatically locking the door in a closed state when a fire occurs, preventing flowing of smoke and fire from one side of the door into the other side to increase the time and opportunities of escape. In an approach, a fire bolt assembly includes a receiving tube mounted in a door, a positioning bolt received in the receiving tube and biased by a spring received in the receiving tube, and a stop member secured in an opening of the receiving tube for maintaining the positioning bolt in the receiving tube. The positioning bolt is moved out of the receiving tube and engages with an engaging hole in another door or a door frame when the stop member melts due to the heat of the fire, allowing locking of the door in the event of a fire. However, the spring could lose its elasticity during the fire and, thus, can not reliably push the positioning bolt to the locking position.

Thus, a need exists for a fire bolt assembly for a door which is capable of reliably preventing the door from being opened when exposed to a fire.

BRIEF SUMMARY OF THE INVENTION

The present invention solves this need and other problems in the field of fire bolt assemblies for reliably locking doors during fires by providing a fire bolt assembly including a receiving tube adapted to be mounted in a door. The receiving tube includes front and rear ends spaced along a first axis. The receiving tube further includes a receiving space extending along the first axis through an end face of the front end of the receiving tube. A mounting member is fixed to the front end of the receiving tube and includes an axial hole in communication with the receiving space of the receiving tube. The mounting member is adapted to be fixed on an end face of the door. A positioning bolt is received in the receiving space of the receiving tube. The positioning bolt includes front and rear ends spaced along the first axis. The positioning bolt further includes a receptacle defined in the rear end of the positioning bolt. A spring is received in the receiving space of the receiving tube. The spring biases the front end of the positioning bolt to an extended position outside of the receiving space of the receiving tube. A stick is received in the receiving space of the receiving tube and includes an abutment end. A stop member is securely mounted in the axial hole of the mounting member. The stop member is made of a material having a melting point lower than melting points of the receiving tube, the mounting member, the positioning bolt, the spring, and the stick.

The stop member holds the positioning bolt in a retracted position in the receiving space of the receiving tube. The abutment end is received in the receptacle of the positioning bolt when the stop member is in the retracted position.

The spring moves the front end of the positioning bolt out of the front end of the receiving tube when the stop member melts, and the abutment end of the stick disengages from the receptacle of the positioning bolt and moves to a blocking position preventing the positioning bolt from moving from the extended position to the retracted position.

In a form shown, the receptacle extends from the rear end through the front end of the positioning bolt. A pin is received in the rear end of the receiving tube and extending perpendicularly to the first axis. The spring is compressed between the rear end of the positioning bolt and the pin when the positioning bolt in the retracted position. The stick includes a pivotal end pivotably connected to the pin. The stick pivots to the blocking position after disengaging from the receptacle of the positioning bolt when the stop member melts.

The present invention will become clearer in light of the following detailed description of illustrative embodiments of this invention described in connection with the drawings.

DESCRIPTION OF THE DRAWINGS

The illustrative embodiments may best be described by reference to the accompanying drawings where:

FIG. 1 shows a schematically perspective view of a fire bolt assembly according to the present invention and a door to which the fire bolt assembly is mounted.

FIG. 3 shows a perspective view of a stop member of the fire bolt assembly of

FIG. 1.

Figure 2:
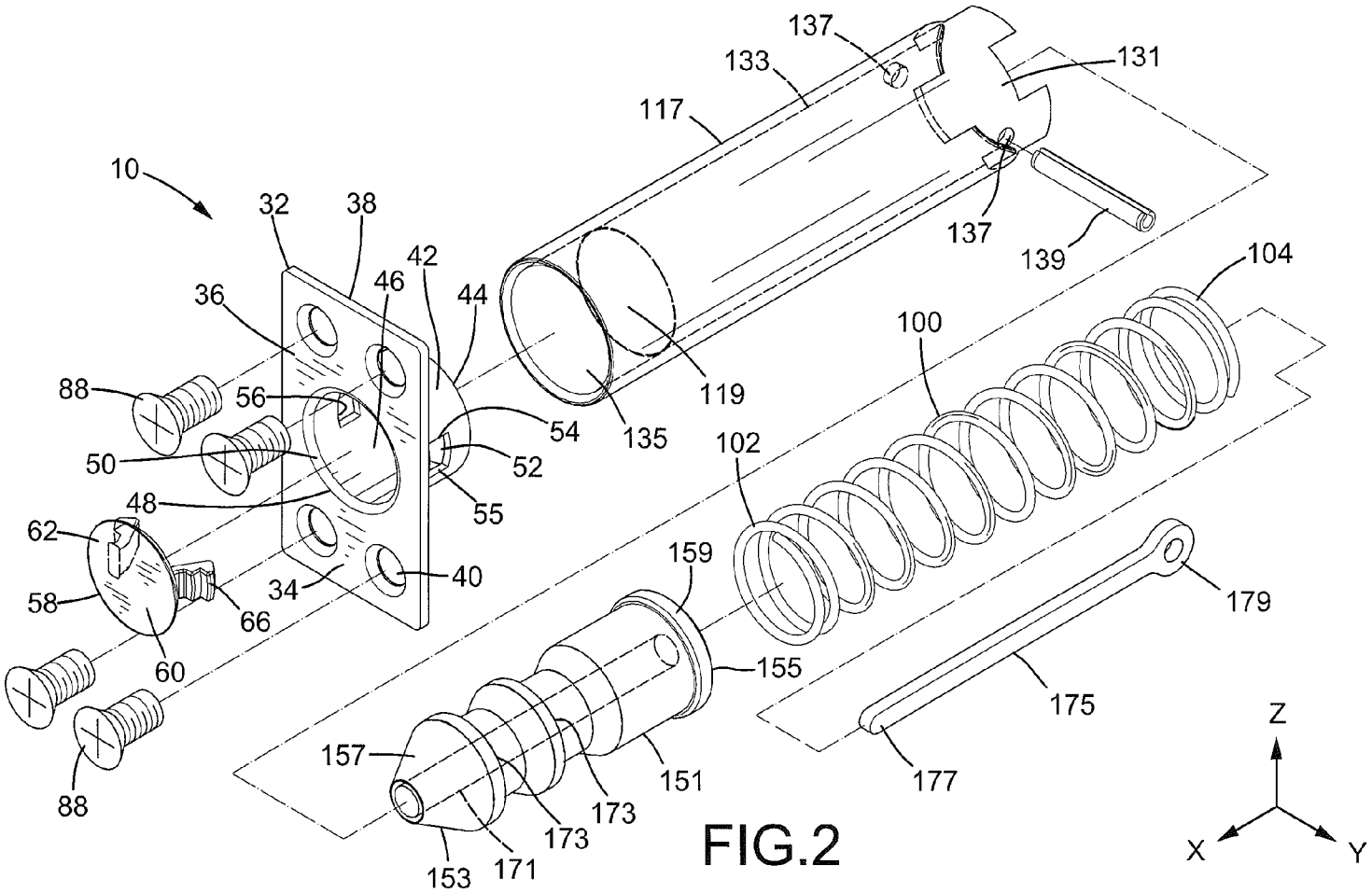
FIG. 2 shows an exploded, perspective view of the fire bolt assembly of FIG. 1.

All figures are drawn for ease of explanation of the basic teachings of the present invention only; the extensions of the figures with respect to number, position, relationship, and dimensions of the parts to form the preferred embodiments will be explained or will be within the skill of the art after the following teachings of the present invention have been read and understood. Further, the exact dimensions and dimensional proportions to conform to specific force, weight, strength, and similar requirements will likewise be within the skill of the art after the following teachings of the present invention have been read and understood.

Where used in the various figures of the drawings, the same numerals designate the same or similar parts. Furthermore, when the terms "first", "second", "third", "upper", "lower", "inner", "outer", "front", "rear", "side", "end", "portion", "radial", "vertical", "inward", "outward", "spacing", "width", "length", and similar terms are used herein, it should be understood that these terms have reference only to the structure shown in the drawings as it would appear to a person viewing the drawings and are utilized only to facilitate describing the invention.

DETAILED DESCRIPTION OF THE INVENTION

A fire bolt assembly is shown in the drawings and generally designated 10. According to the form shown, fire bolt assembly 10 is mounted in a door 106. Door 106 includes an end face 108 extending in a vertical direction and a mounting hole 110 extending along a first axis X perpendicular to the vertical direction and having an opening 111 in end face 108. Door 106 and another door 112 are respectively and pivotably mounted to opposite sides of a door frame. Door 112 includes an end face 114 extending in the vertical direction and a coupling hole 116 formed in end face 114 and aligned with mounting hole 110 of door 106 when doors 106 and 112 are in a closed state. It can be appreciated that door 112 can be replaced with a door frame having coupling hole 116 formed in end face 114 thereof.

According to the form shown, fire bolt assembly 10 includes a receiving tube 117 made of metal and having circular cross sections. Receiving tube 117 includes front and rear ends 119 and 131 spaced along first axis X. Receiving tube 117 further includes a receiving space 133 extending along first axis X and having an opening 135 in front end 119. Rear end 131 of receiving tube 117 includes two diametrically opposed pin holes 137. A pin 139 extends through pin holes 137. Several tabs protrude outwards from rear end 131 of receiving tube 117 along first axis X and are spaced from each other in a circumferential direction of rear end 131 of receiving tube 117. Receiving tube 117 is received in mounting hole 110 of door 106 with front end 119 of receiving tube 117 facing end face 108 of door 106.

According to the form shown, fire bolt assembly 10 further includes a mounting member 32. Mounting member 32 includes a mounting plate 34 having rectangular cross sections and having first and second faces 36 and 38 spaced along first axis X. Four spaced fixing holes 40 are provided in mounting plate 34 and extend from first face 36 through second face 38 of mounting plate 34. Mounting member 32 further includes a sleeve 42 protruding from second face 38 and extending away from first face 36 of mounting plate 34 along first axis X. Sleeve 42 includes a front end 43 interconnected to second face 38 of mounting plate 34 and a rear end 44 spaced from front end 43 along first axis X and distant to second face 38 of mounting plate 34. An axial hole 46 extends from first face 36 of mounting plate 34 through sleeve 42 along first axis X and includes an opening 48 in first face 36 of mounting plate 34. Opening 48 includes an inner periphery 50 (FIG. 4A) that is rounded such that the maximum inner diameter of opening 48 is larger than an inner diameter of axial hole 46.

Figure 4:
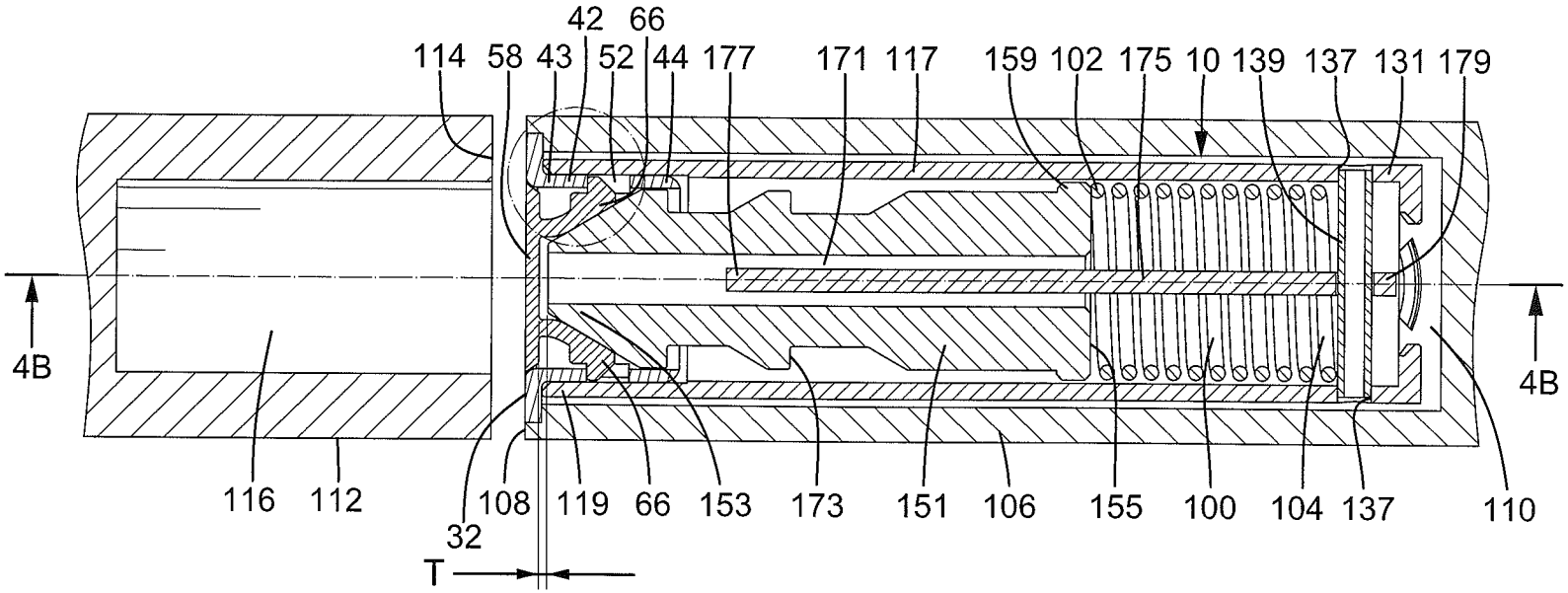
FIG. 4 shows a cross sectional view of the fire bolt assembly and the door of FIG. 1 according to section line 4-4 of FIG. 1, with another door shown aligned with the door.
Figure 4A:
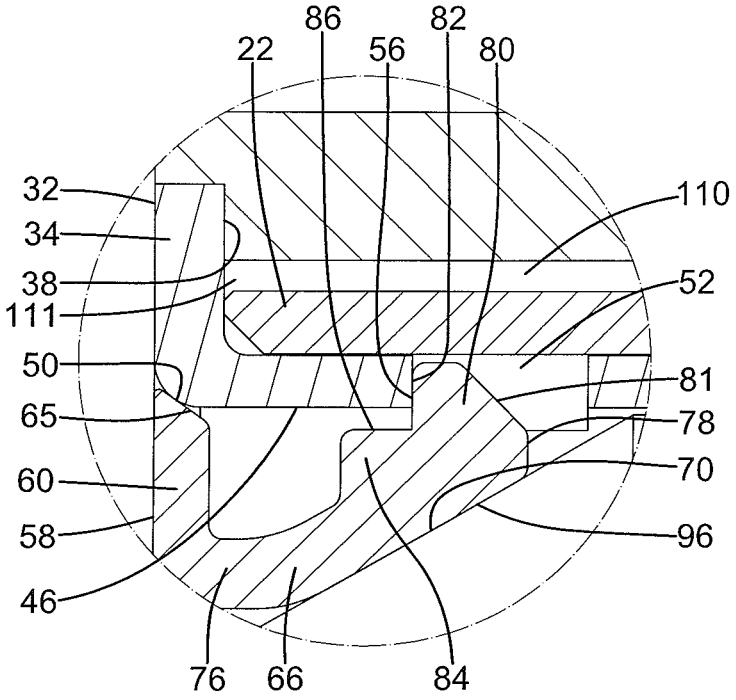
FIG. 4A shows an enlarged view of a circled portion of FIG. 4.

Sleeve 42 of mounting member 32 further includes inner and outer peripheries spaced in a radial direction perpendicular to first axis X. Sleeve 42 of mounting member 32 further includes first and second engaging portions 52 spaced along a second axis Y perpendicular to the first axis X. In the form shown, each engaging portion 52 is a radial hole extending in the radial direction from the outer periphery through the inner periphery of sleeve 42. Each engaging portion 52 includes upper and lower end faces 54 and 55 spaced along a third axis Z perpendicular to first and second axes X and Y. Each engaging portion 52 further includes a coupling face 56 formed by a side wall interconnected between upper and lower end faces 54 and 55 and extending along the third axis Z. Coupling faces 56 of first and second engaging portions 52 are spaced from second face 38 of mounting plate 34 along first axis X (FIG. 4A). Furthermore, sleeve 42 of mounting member 32 extends through front end 119 of receiving tube 117 and is secured in receiving space 133 of receiving tube 117 by welding such that front end 119 of receiving tube 117 abuts second face 38 of mounting plate 34. Screws 88 extend through fixing holes 40 of mounting plate 34 into door 106 to secure mounting member 32 to door 106 with first face 36 of mounting plate 34 flush with end face 108 of door 106 (FIG. 1).

According to the form shown, fire bolt assembly 10 further includes a stop member 58 made of plastic material. Stop member 58 includes a stop plate 60 having front and rear surfaces 62 and 64 spaced along first axis X. Stop plate 60 of stop member 58 further includes a peripheral wall 65 tapering from front surface 62 towards rear surface 64 and having a conicity corresponding to inner periphery 50 of opening 48 of mounting plate 34. Stop member 58 is mounted in axial hole 46 of mounting member 32, with peripheral wall 65 of stop plate 60 abutting inner periphery 50 of opening 48 of mounting member 32.

Stop member 58 further includes first and second legs 66 spaced along second axis Y and each protruding from rear surface 64 and extending away from front surface 62 of stop plate 60 along first axis X. Each leg 66 includes a connecting end 76 interconnected to rear surface 64 of stop plate 60 and a free end 78 spaced from connecting end 76 along first axis X and distant to rear surface 64 of stop plate 60. Each leg 66 further includes outer and inner side faces 68 and 70 spaced along second axis Y. Inner side faces 70 of legs 66 face each other. Outer side face 68 of connecting end 76 of each leg 66 is spaced from sleeve 42 of mounting member 32. A spacing perpendicular to first axis X between inner side faces 70 of connecting ends 76 of legs 66 is smaller than that between inner side faces 70 of free ends 78 of legs 66. A width perpendicular to first axis X between outer side faces 68 of free ends 78 of legs 66 is larger than a diameter of axial hole 46 of mounting member 32. Each leg 66 further includes upper and lower faces 72 and 74 spaced along third axis Z. A hook 80 is formed on outer side face 68 of each leg 66 and includes an inclined face 81 adjacent to free end 78 of each leg 66. Hook 80 further includes an engaging face 82 facing rear surface 64 of stop plate 60 and extending along third axis Z. A projection 84 is formed on outer side face 68 of each leg 66 and adjacent to a side of hook 80. Projection 84 of each leg 66 includes a stop face 86 extending along third axis Z.

In installation of stop member 58 into axial hole 46 of mounting member 32, legs 66 of stop member 58 are extended into axial hole 46 of mounting member 32 with free ends 78 of legs 66 pressed radially inward. Free ends 78 of legs 66 deform so that inclined face 81 of each leg 66 slides along inner periphery 50 of opening 48 of mounting member 32 to guide legs 66 of stop member 58 into axial hole 46 of mounting member 32. When hooks 80 of stop member 58 are respectively aligned with engaging portions 52 of sleeve 42 of mounting member 32, each hook 80 of stop member 58 is engaged in one of engaging portions 52 of sleeve 42 by the resiliency of legs 66 with engaging face 82 of each hook 80 engaged with one of coupling faces 56 of engaging portions 52, preventing movement of stop member 58 relative to mounting member 32. Furthermore, upper and lower faces 72 and 74 of each leg 66 respectively abut upper and lower end faces 54 and 55 of each engaging portion 52.

Figure 4B:
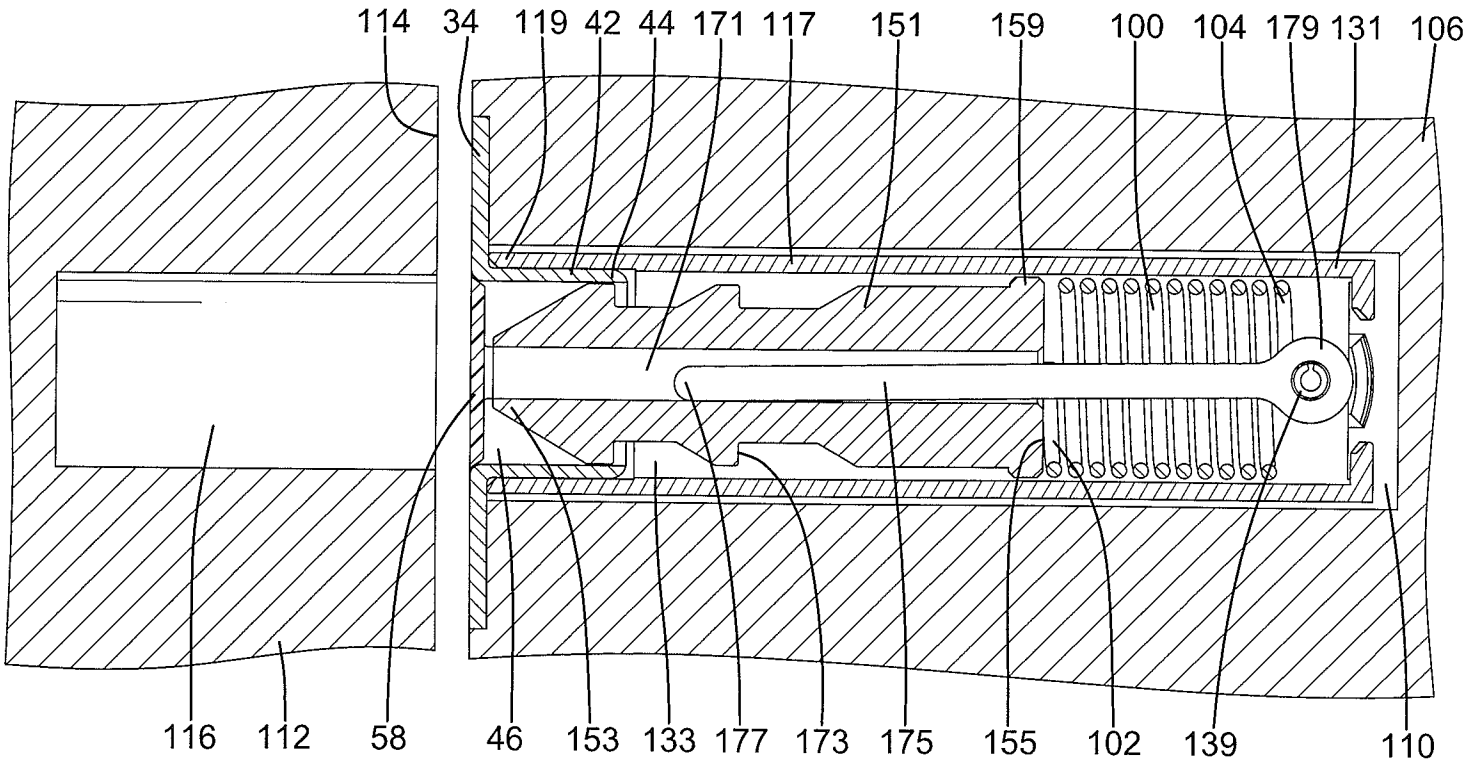
FIG. 4B is a cross sectional view taken along section line 4B-4B of FIG. 4.

According to the form shown, a positioning bolt 151 is slideably received in receiving space 133 of receiving tube 117 and includes front and rear ends 153 and 155 spaced along first axis X. Front end 153 of positioning bolt 151 includes an abutting periphery 157 tapering away from rear end 155 of positioning bolt 151. Positioning bolt 151 further includes a flange 159 on rear end 155. Flange 159 has a diameter perpendicular to first axis X greater than those of positioning bolt 151 and axial hole 46 of mounting member 32. Positioning bolt 151 further includes a receptacle 171 extending from rear end 155 through front end 153 along first axis X. Two annular grooves are formed in outer periphery of positioning bolt 151, forming two shoulders 173 between abutting periphery 157 and flange 159. Front end 153 of positioning bolt 151 is spaced from rear surface 64 of stop plate 60 along first axis X by a spacing T. Positioning bolt 151 is initially in a retracted position (FIGS. 4 and 4B).

According to the form shown, a stick 175 is received in receiving space 133 of receiving tube 117 and includes an abutment end 177 and a pivotal end 179. Pin 139 extends through pivotal end 179, allowing stick 175 to pivot about a pivot axis defined by pin 139.

According to the form shown, a spring 100 is received in receiving space 133 of receiving tube 117 and mounted around stick 175 and is compressed between rear end 155 of positioning bolt 151 and pin 139. Spring 100 includes a first end 102 abutting against rear end 155 of positioning bolt 151 and a second end 104 abutting against an outer periphery of pin 139 so that front end 153 of positioning bolt 151 is biased by spring 100 and presses against inner side faces 70 of first and second legs 66 of stop member 58, with front end 153 of positioning bolt 151 spaced from rear surface 64 of stop plate 60 along first axis X by spacing T (FIG. 4). Thus, stop member 58 is not pressed by positioning bolt 151 and, thus, will not disengage from mounting member 32, retaining positioning bolt 151 in the retracted position in receiving space 133 of receiving tube 117. When positioning bolt 151 and spring 100 are received in receiving space 133 of receiving tube 117, the tabs of receiving tube 117 are bent to form the end face of rear end 131 of receiving tube 117, retaining positioning bolt 151 and spring 100 in receiving space 133 of receiving tube 117 (see FIGS. 2 and 4).

Fire bolt assembly 10 provides fire-resistant functions. Specifically, stop member 58 retains positioning bolt 151 in receiving tube 117 when fire bolt assembly 10 is in normal situations (FIGS. 4 and 4B). Note that a portion of stick 175 including abutment end 177 is in a non-blocking position received in receptacle 171 of positioning bolt 151 in the retracted position.

Figure 5:
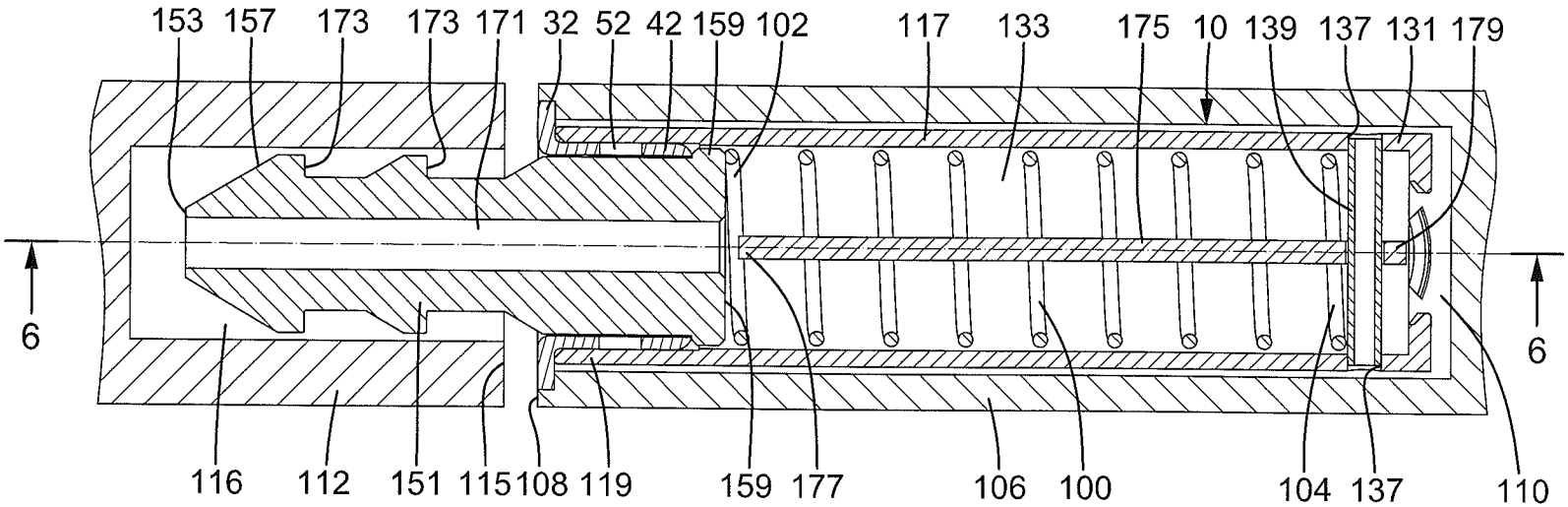
FIG. 5 shows a cross sectional view similar to FIG. 4, with a positioning bolt of the fire bolt assembly of FIG. 4 moved into a coupling hole in the other door after the stop member melts.
Figure 6:
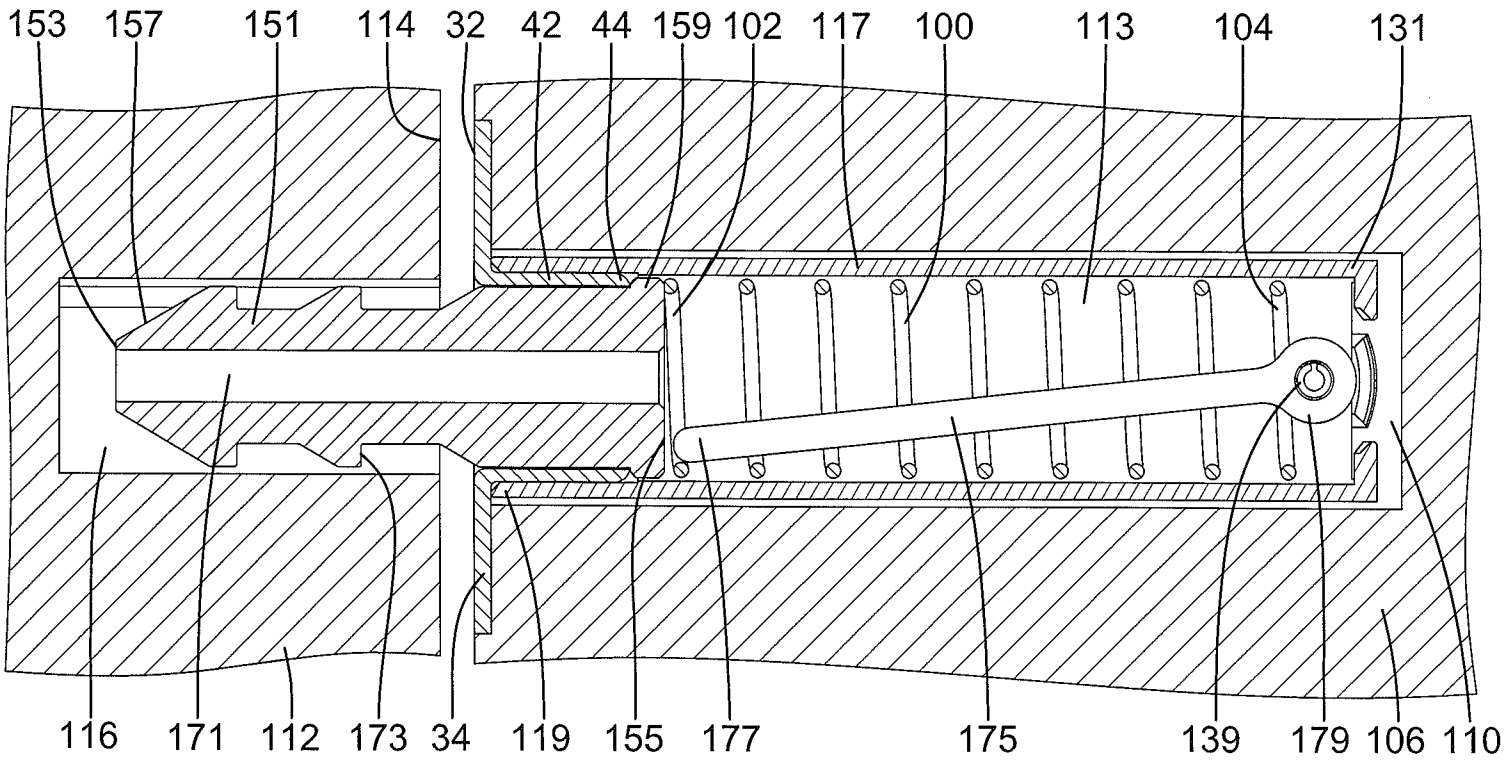
FIG. 6 is a cross sectional view taken along section line 6-6 of FIG. 5.

On the other hand, when doors 106 and 112 and fire bolt assembly 10 are exposed to a fire and when stop member 58 melts by the heat of the fire, front end 153 of positioning bolt 151 is biased by spring 100 and moved out of receiving tube 117 to an extended position to engage with coupling hole 116 in door 112, locking doors 106 and 112 and preventing doors 106 and 112 from undesired opening (FIGS. 5 and 6). Note that flange 159 of positioning bolt 151 abuts against rear end 44 of sleeve 42 when front end 153 of positioning bolt 151 extends out of front end 119 of receiving tube 117 while stop member 58 melts. Shoulders 173 of positioning bolt 151 are also received in coupling hole 116. If doors 106 and 112 pivot through a small angle under action by an external force, interference occurs between one of shoulders 173 of positioning bolt 151 and a portion of an inner periphery of coupling hole 116 adjacent to end face 114, preventing further pivotal movement of doors 106 and 112. Thus, positioning bolt 151 will not disengage from coupling hole 116 of door 112, avoiding opening of doors 106 and 112.

Note that stick 175 is located outside of receptacle 171 of positioning bolt 151 after positioning bolt 151 reaches the extended position. Furthermore, stick 175 pivots downward under action of the gravitational force to a blocking position aligning with an end face of rear end 155 but not aligned with receptacle 171 (FIG. 6). Thus, positioning bolt 151 can not move from the extended position to the retracted position. Even if spring 100 loses its elasticity by the heat of the fire, positioning bolt 151 is reliably retained in the extended position by stick 175 to reliably avoid positioning bolt 151 from disengaging from coupling hole 116 of door 112.

Furthermore, fire bolt assembly 10 reduces failure of the locking function of positioning bolt 151. Specifically, only two legs 66 of stop member 58 are received in axial hole 46 of mounting member 32 so that less material of the melted stop member 58 remains in the mounting member 32. Thus, positioning bolt 151 will not be blocked by the melted stop member 58 and can reliably move out of receiving tube 117 after stop member 58 has melted.

Now that the basic teachings of the present invention have been explained, many extensions and variations will be obvious to one having ordinary skill in the art. For example, positioning bolt 151 does not have to include flange 159 in a case that the length of positioning bolt 151 along first axis X is larger than that of coupling hole 116 in door 112. Furthermore, positioning bolt 151 does not have to include shoulders 173. Furthermore, coupling face 56 can be in the form of a protrusion instead of a radial hole. Although second axis Y is perpendicular to the vertical direction and third axis Z is parallel to the vertical direction in the form shown, it can be appreciated that second axis Y can be parallel to the vertical direction and third axis Z can be perpendicular to the vertical direction. Receptacle 171 can be a blind hole defined in rear end 155 of positioning bolt 151.

Thus since the invention disclosed herein may be embodied in other specific forms without departing from the spirit or general characteristics thereof, some of which forms have been indicated, the embodiments described herein are to be considered in all respects illustrative and not restrictive. The scope of the invention is to be indicated by the appended claims.

The invention claimed is:

1. A fire bolt assembly for a door comprising:

a receiving tube (117) adapted to be mounted in a door (106), with the receiving tube (117) including front and rear ends (119, 131) spaced along a first axis, with the receiving tube (117) further including a receiving space (133) extending along the first axis through an end face of the front end (119) of the receiving tube (117);

a mounting member (32) fixed to the front end (119) of the receiving tube (117), with the mounting member (32) including an axial hole (46) in communication with the receiving space (133) of the receiving tube (117), with the mounting member (32) adapted to be fixed on an end face (108) of the door (106);

a positioning bolt (151) received in the receiving space (133) of the receiving tube (117), with the positioning bolt (151) including front and rear ends (153, 155) spaced along the first axis, with the positioning bolt (151) further including a receptacle (171) defined in the rear end (155) of the positioning bolt (151);

a spring (100) received in the receiving space (133) of the receiving tube (117), with the spring (100) biasing the front end (153) of the positioning bolt (151) to an extended position outside of the receiving space (133) of the receiving tube (117);

a stick (175) received in the receiving space (133) of the receiving tube (117), with the stick (175) including an abutment end (177); and a stop member (58) securely mounted in the axial hole (46) of the mounting member (32), with the stop member (58) made of a material having a melting point lower than melting points of the receiving tube (117), the mounting member (32), the positioning bolt (151), the spring (100), and the stick (175), with the stop member (58) holding the positioning bolt (151) in a retracted position in the receiving space (133) of the receiving tube (117), with the abutment end (177) received in the receptacle (171) of the positioning bolt (151), with the spring (100) moving the front end (153) of the positioning bolt (151) out of the front end (119) of the receiving tube (117) when the stop member (58) melts, with the abutment end (177) of the stick (175) disengaged from the receptacle (171) of the positioning bolt (151) and moved to a blocking position preventing the positioning bolt (151) from moving from the extended position to the retracted position.

2. The fire bolt assembly as claimed in claim 1, with the receptacle (171) extending from the rear end (155) through the front end (153) of the positioning bolt (151), with a pin (139) received in the rear end (131) of the receiving tube (117) and extending perpendicularly to the first axis, with the spring (100) compressed between the rear end (155) of the positioning bolt (151) and the pin (139) when the positioning bolt (151) in the retracted position, with the stick (175) including a pivotal end (179) pivotably connected to the pin (139), with the stick (175) pivoting to the blocking position after disengaging from the receptacle (171) of the positioning bolt (151) when the stop member (58) melts.

3. The fire bolt assembly as claimed in claim 1, with the front end (153) of the positioning bolt (151) including an abutting periphery (157), with the abutting periphery (157) being conical, with the mounting member (32) including a sleeve (42) received in the receiving space (133) of the receiving tube (117), with the axial hole (46) extending through the sleeve (42), with the sleeve (42) including first and second coupling faces (56) spaced along a second axis perpendicular to the first axis, with the stop member (58) including a stop plate (60) having front and rear surfaces (62, 64) spaced along the first axis, with the stop member (58) further including first and second legs (66) spaced along the second axis and each protruding from the rear surface (64) and extending away from the front surface (62) of the stop plate (60) along the first axis, with each of the first and second legs (66) extending into the axial hole (46) of the mounting member (32), with each of the first and second legs (66) including a connecting end (76) interconnected to the rear surface (64) of the stop plate (60) and a free end (78) distant to the rear surface (64) of the stop plate (60), with the free end (78) spaced from the connecting end (76) along the first axis, with each of the first and second legs (66) further including outer and inner side faces (68, 70) spaced along the second axis, with the inner side faces (70) of the first and second legs (66) facing each other, with a spacing perpendicular to the first axis between the inner side faces (70) of the connecting ends (76) of the first and second legs (66) being smaller than that between the inner side faces (70) of the free ends (78) of the first and second legs (66), with a hook (80) formed on the outer side face (68) of the free end (78) of each of the first and second legs (66) and including an engaging face (82) extending in a third axis perpendicular to the first and second axes, with the engaging face (82) of each hook (80) engaging with one of the first and second coupling faces (56) of the sleeve (42) of the mounting member (32), and with the abutting periphery (157) of the positioning bolt (151) being biased by the spring (100) and pressing against the inner side faces (70) of the first and second legs (66) of the stop member (58), preventing the stop member (58) from disengaging from the mounting member (32).

* * * * *